US005460562A

United States Patent [19]

Lecere et al.

[11] Patent Number: 5,460,562

[45] Date of Patent: Oct. 24, 1995

[54] MACHINE FOR GRINDING OPHTHALMIC GLASSES

[75] Inventors: Michel J. M. Lecere, La Saussaye; Jean-Pierre M. F. Langlois, Rouen, both of France

[73] Assignee: Buchmann Optical Engineering, Ypres, Belgium

[21] Appl. No.: 201,773

[22] Filed: Feb. 25, 1994

[30] Foreign Application Priority Data

Mar. 11, 1993 [FR] France ..... 93 02810

[51] Int. Cl.[6] ..... B24B 49/00

[52] U.S. Cl. ..... 451/5; 451/384; 451/398

[58] Field of Search ..... 451/42, 41, 5, 451/240, 255, 256, 277, 323, 325, 384, 398

[56] References Cited

U.S. PATENT DOCUMENTS

| | | | |
|---|---|---|---|
| 3,012,379 | 12/1961 | Kuhlman | 451/42 |
| 3,893,264 | 7/1975 | Behnke | 451/42 |
| 4,003,165 | 1/1977 | Saun | 451/240 |
| 4,068,413 | 1/1978 | Suddarth | 451/159 |
| 4,596,091 | 6/1986 | Daboudet et al. | 451/240 |
| 4,829,715 | 5/1989 | Langlois et al. | 451/43 |
| 5,022,187 | 6/1991 | Longuet et al. | 451/8 |
| 5,053,971 | 10/1991 | Wood et al. | 451/43 |
| 5,148,637 | 9/1992 | Byron | 451/43 |
| 5,161,333 | 11/1992 | Lecerf et al. | 451/21 |

*Primary Examiner*—Bruce M. Kisliuk
*Assistant Examiner*—Derris H. Banks
*Attorney, Agent, or Firm*—Harrison & Egbert

[57] ABSTRACT

A machine for grinding opthalmic glasses including a carriage, a clamping shaft carried by the carriage and composed of two shaft parts for clamping therebetween an opthalmic glass blank, and a clamp cooperative with at least one of the shaft parts for exerting an axial force thereon. The clamp includes a motor-speed reducer unit having a motor, transmission elements for transmitting the driving force of the motor to at least one of the shaft parts, a housing enclosing the motor and the transmission elements and mounted relative to the carriage to pivot about a pivot axis, a reaction spring connecting the housing to the carriage, and a control unit associated with the motor and with the spring for varying the driving force of the motor as a function of the variation in the length of the spring.

6 Claims, 1 Drawing Sheet

MACHINE FOR GRINDING OPHTHALMIC GLASSES

BACKGROUND OF THE INVENTION

The present invention relates to a machine for grinding ophthalmic glasses.

The invention is for example applicable to a machine for grinding ophthalmic glasses of the type comprising a stand, a carriage, for example generally U-shaped, mounted on a first shaft so as to be pivotable relative to the stand, a second shaft parallel to the first shaft and comprising at least one grinding wheel driven in rotation by an electric motor, the carriage carrying a clamping shaft parallel to the first shaft and made in two parts between which a glass blank to be ground is held and also driven in rotation for the grinding operations.

The machine comprises for this purpose clamping means which exert an axial force on at least one of the two parts of the clamping shaft and which comprise for this purpose at least one motor-speed reducer unit comprising a motor and means for transmitting the driving force of the motor arranged in a housing.

The output of the motor-speed reducer unit is for example connected to a gear pinion for driving a rack formed on a clamping rod which exerts an axial force on one of the two parts of the clamping shaft.

The glass blank is clamped by supplying the electric motor of the motor-speed reducer unit with power so that it provides a driving force, i.e. a driving torque, which is converted into an axial clamping force by the motor-speed reducer unit and the rack and pinion device.

It has been found that, in the course of utilization of the machine with consequent wear of its component parts, the efficiency of the assembly comprising the motor-speed reducer unit and the rack and pinion device varies, with the result that variations in the clamping force may be particularly high, for example on the order of 30%.

In known machines for grinding ophthalmic glasses, it is consequently not possible to reliably and durably control the value of the clamping force on the glass blank to be ground.

SUMMARY OF THE INVENTION

In order to overcome these drawbacks, the invention provides a machine for grinding ophthalmic glasses of the type comprising a carriage which carries a clamping shaft in two parts between which an ophthalmic glass blank is clamped and of the type comprising clamping means which exert an axial force on at least one of the two parts of the clamping shaft and include for this purpose at least one motor-speed reducer unit comprising a motor and transmission elements transmitting the driving force of the motor arranged in a housing, characterized in that the housing of the motor-speed reducer unit is pivotally mounted relative to the carriage, the housing is connected to the carriage by a reaction spring, and a control unit is provided for varying the driving force of the motor as a function of the variation in the length of the spring.

According to other features of the invention:

the control unit comprises means for sensing a variation in the length of the spring;

said means comprise an amplifying arm which has a first end fixed to the housing of the motor-speed reducer unit, extends in a direction perpendicular to the axis about which the housing pivots relative to the carriage, and has a second end connected to the spring;

the second end of the arm is connected to a sensor sensing the displacements of said end;

the control unit comprises means for controlling the value of the driving force of the motor as a function of a parameter representing variations in the length of the spring;

the clamping means comprise a clamping rod which acts on said one of the parts of the clamping shaft and includes a rack with which cooperates a driving gear pinion connected to the output of the motor-speed reducer unit.

BRIEF DESCRIPTION OF THE DRAWINGS

Further features and advantages of the invention will be apparent from the following detailed description with reference to accompanying drawings, in which.

DESCRIPTION OF A PREFERRED EMBODIMENT OF THE INVENTION

Figure 2:
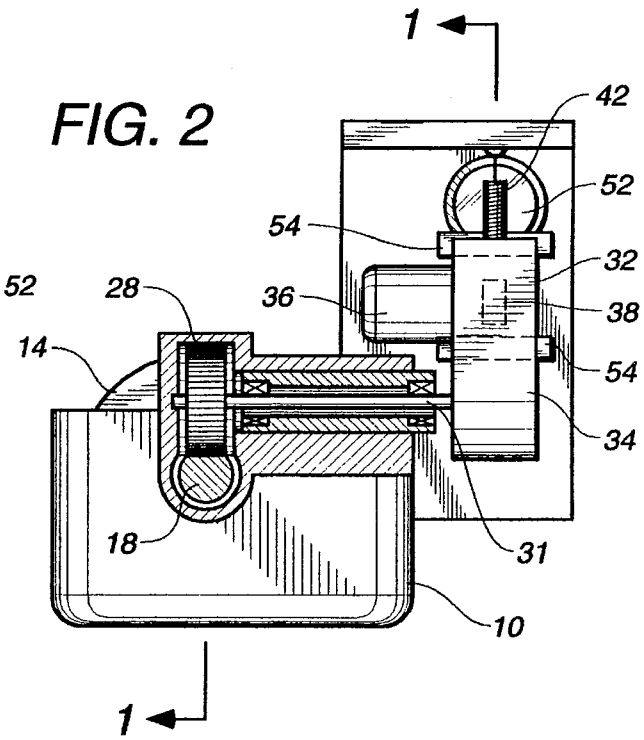
FIG. 2 is a partial sectional view taken on line 2—2 of FIG. 1.
Figure 1:
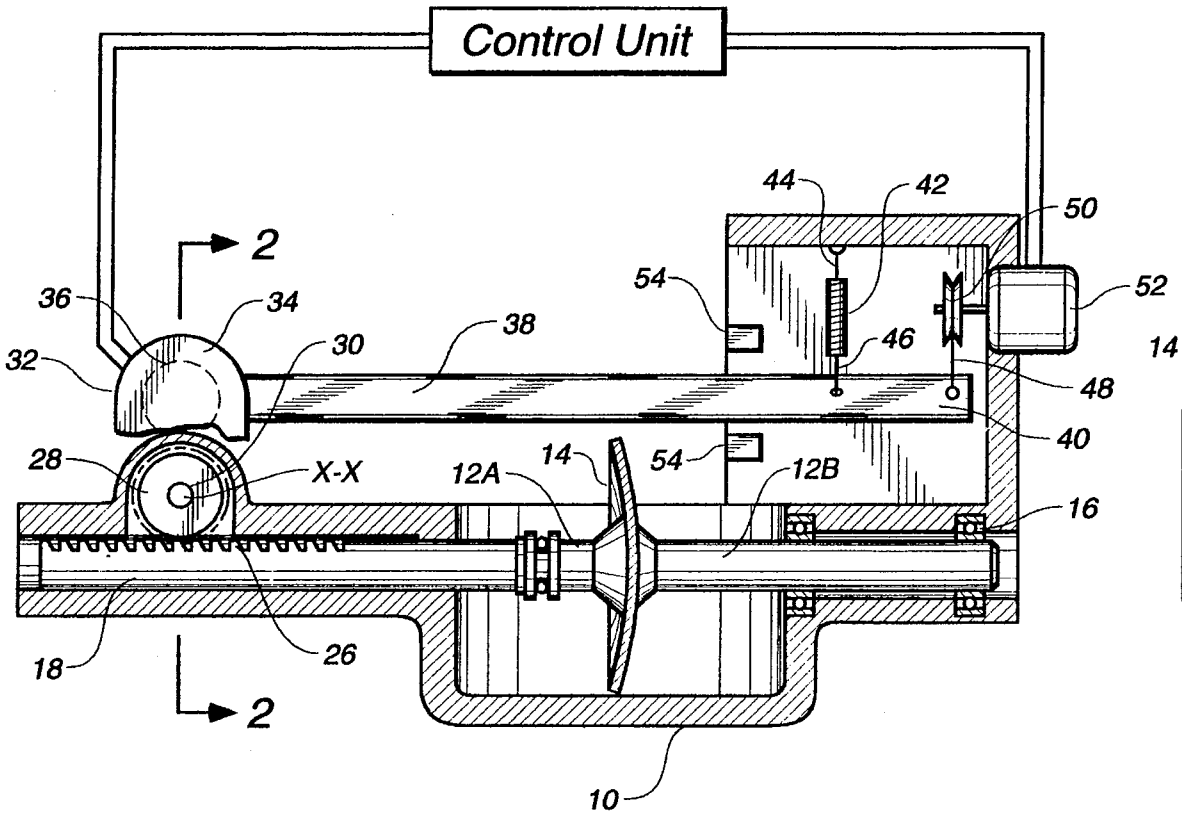
FIG. 1 is a partial sectional view taken on line 1—1 of FIG. 2 of the device for clamping an ophthalmic glass which is integrated in the carriage of a glass grinding machine.

FIGS. 1 and 2 show a part of the carriage 10 of an ophthalmic glass grinding machine of known design which carries a shaft in two parts 12A and 12B between which a glass blank 14 to be ground is held.

The part 12B of the clamping shaft for the blank 14 is rotatively mounted in the carriage 10 and held axially stationary relative to the latter in the vicinity of its right end, as viewed in FIG. 1, by an axial thrust ball bearing 16.

The second half 12A of the clamping shaft is rotatively mounted relative to the carriage 10 and is axially acted upon by a clamping rod 18 which is axially slidably mounted and has a right end 20 which acts through a thrust ball bearing 22 on the left axial end 24 of the part 12A of the clamping shaft.

For this purpose, the rod 18 comprises a rack 26 on which acts a driving gear pinion 28 mounted on a driving shaft 30 rotatively mounted in the carriage 10.

The driving shaft 30 of the driving pinion 28 is connected to the output of a motor-speed reducer unit 32 comprising a housing 34 in which is arranged a gear train of the unit and on which is mounted an electric driving motor 36.

The housing 34 is suspended from the end 31 of the driving shaft 30 of the pinion 28 and is laterally extended from the left toward the right, as viewed in FIG. 1, by an amplifying arm 38.

The arm 38 is provided, in the vicinity of its free end 40, with a tension coil spring 42 having one end 44 fixed to the carriage 10 and the opposite end 46 fixed to the arm 38.

The end 40 is also connected to a cable 48 which is wound round a pulley 50 of a rotation sensor 52.

The rigid assembly constituted by the housing 34 of the motor-speed reducer unit 32 and the arm 38 is consequently mounted to pivot about the axis X—X of rotation of the driving shaft 30 of the rack pinion 28.

The movements of this assembly are angularly limited by two stops 54 formed on the carriage 10 and between which the body of the arm 38 extends.

The electric driving motor 36 and the rotation sensor 52 are connected to an electronic unit (as shown) which, in accordance with the invention, provides a precise and permanent control of the clamping force applied to the glass blank 14 so as to maintain this clamping force at a predetermined constant value.

Indeed, when the motor 36 is supplied with power, it causes the clamping of the blank 14 by means of the device comprising the pinion 26 and the rack 28, this clamping action having its reaction through the arm 38 connected to the housing 34 of the motor-speed reducer unit which then pivots, in the clockwise direction as viewed in FIG. 1, about the axis X—X and thus exerts a tensile force on the reaction spring 42. The angle of the pivoting of the arm 38 may be angularly measured by the sensor 52 which then transmits a corresponding signal to the electronic unit.

The value of the angle of the pivoting of the amplifying arm 38, which directly corresponds to the tensile force applied by the arm 38 to the spring 42, consequently permits controlling the value of the supply current of the motor 36 so as to regulate, and if need be modify, the clamping force applied to the blank 14.

The use of an arm 38 of great length provides high precision of the regulation in that it amplifies the movements in the region of the sensor 48, 52 and permits using a spring 42 having an elastic constant of relatively low value.

It must be understood that the invention just described is not intended to be limited to this embodiment but is also applicable in the case where the device driving the clamping rod 18 is of another design, for example of the screw-and nut type in which the nut is for example driven in rotation by an electric motor through a speed reducer.

What is claimed is:

1. A machine for grinding ophthalmic glasses comprising a carriage, a clamping shaft carried by said carriage and composed of two shaft parts for clamping therebetween an ophthalmic glass blank, clamping means cooperative with at least one of said shaft parts for exerting an axial force thereon, said clamping means comprising a motor-speed reducer unit including a motor, transmission elements for transmitting the driving force of said motor to said at least one of said shaft parts, a housing enclosing said motor and said transmission elements and mounted relative to said carriage to pivot about a pivot axis, a reaction spring connecting said housing to said carriage, and a control unit associated with said motor and with said spring for varying the driving force of said motor as a function of variation in the length of said spring.

2. Machine according to claim 1, wherein said control unit comprises means for sensing a variation in the length of said spring.

3. Machine according to claim 2, wherein said sensing means comprise an amplifying arm which has a first end portion fixed to said housing, extends in a direction perpendicular to said pivot axis, and has a second end portion connected to said spring.

4. Machine according to claim 3, comprising a sensor connected to said second end portion of said amplifying arm for sensing displacements of said second end portion.

5. Machine according to claim 1, wherein said control unit comprises means for controlling the value of said driving force of said motor as a function of a parameter representing variations in the length of said spring.

6. Machine according to claim 1, wherein said clamping means comprise a clamping rod drivingly connected to said at least one of said shaft parts and including a rack, said motor-speed reducer unit having an output shaft and a gear pinion fixed on said output shaft and drivingly connected to said rack.

* * * * *